US005857854A

United States Patent [19]

Kwalwasser

[11] Patent Number: 5,857,854

[45] Date of Patent: Jan. 12, 1999

[54] RECOIL SIMULATOR FOR A WEAPON

[76] Inventor: Yaakov Kwalwasser, POB. 4388, Rishon Lezion 75140, Israel

[21] Appl. No.: 954,068

[22] Filed: Oct. 20, 1997

[30] Foreign Application Priority Data

Oct. 21, 1996 [IL] Israel ..... 119463

[51] Int. Cl.[6] ..... F41F 27/00

[52] U.S. Cl. ..... 434/18

[58] Field of Search ..... 434/18

[56] References Cited

U.S. PATENT DOCUMENTS

| | | | |
|---|---|---|---|
| 2,708,319 | 5/1955 | Tratsch | 434/18 |
| 4,480,999 | 11/1984 | Witherell et al. | 434/18 |
| 4,829,877 | 5/1989 | Zerega | 434/18 X |

*Primary Examiner*—John A. Ricci
*Attorney, Agent, or Firm*—Edward Langer

[57] ABSTRACT

A weapons simulator in which the rifle barrel is modified as a cylinder provided with a piston designed for movement therein, to provide a recoil effect. The rifle barrel itself serves as the cylinder and the piston is arranged for sliding motion therein, to provide the recoil effect, while actuating a rifle bolt mechanism. An end of the piston is provided with O-rings to seal it against the inside walls of the barrel. A portion of the barrel inside walls is conically shaped, defining a gap which the O-rings do not seal. Travel of the piston end through this barrel portion enables rapid compressed air exhaustion via the gap, simulating recoil. The conically-shaped barrel portion also guides piston re-entry into the cylinder, during a retraction motion of the rifle bolt mechanism.

24 Claims, 8 Drawing Sheets

RECOIL SIMULATOR FOR A WEAPON

FIELD OF THE INVENTION

The present invention relates to weapons simulation in military training and civilian game and sport environments, and more particularly, to a recoil simulator for an automatic or semi-automatic rifle or pistol to provide realistic firing characteristics including authentic recoil action and sound, to improve the effectiveness of marksmanship training exercises.

BACKGROUND OF THE INVENTION

Small weapons simulators generally rely on pneumatic cylinder and piston arrangements installed in a weapon for simulating recoil action to enhance the "feel" of simulated firing exercises.

Prior art examples of small weapons simulators include the disclosure of U.S. Pat. No. 4,380,437 to Yarborough, featuring a recoil module based on a pneumatic cylinder and piston installed in a rifle butt. A valve actuated by a trigger allows compressed air to flow into the recoil module (piston), to provide an impulse simulating rifle firing, with live ammunition. The recoil module is a standard, manufactured unit for purchase.

A weapons trainer having a projection screen video system and a simulated weapon is disclosed in U.S. Pat. No. 5,035,622 to Marshall et al, featuring recoil of the simulated weapon provided by pneumatics.

In prior art weapons simulators, the air piston is used to push and pull the bolt mechanism. Since the air piston must release trapped air, its motion is slower than the gun mechanism itself, and thus the recoil feeling is not realistic. A pneumatic trigger mechanism is often used, and this is not a faithful simulation of a real trigger. No "click" is heard, or the hammer is generally eliminated, so the real "feel" of a weapon is absent. Usually some mechanical elements in the trigger mechanism are eliminated or modified.

In addition, the difficulty associated with repairing simulated weapons which utilize a pneumatic cylinder is due to the need to remove the cylinder, which is a time consuming process. Many air connections are needed in these designs, since the air flow is directed to provide two-directional rifle bolt movement, and these air connections complicate the breakdown and re-assembly procedure, making for costly maintenance and repair.

Thus, it would be desirable to provide recoil simulation without installing an external air cylinder for recoil.

SUMMARY OF THE INVENTION

Accordingly, it is a principal object of the present invention to overcome the above-mentioned disadvantages of prior art weapons simulator designs, and provide a weapons simulator in which the rifle barrel is modified as a cylinder having a piston designed for movement therein, to provide a recoil effect.

In accordance with a preferred embodiment of the present invention, there is provided a recoil simulator for a weapon comprising:

a rifle barrel having a sealing plug disposed therein proximate an exit end thereof, said barrel being formed with an inlet opening behind said plug for entry of compressed air therein; and a piston rod and cylinder arranged for sliding motion one with respect to the other, a gap being developed therebetween during a portion of said sliding motion, said cylinder being in fluid communication with said barrel inlet opening, said sliding motion being arranged to actuate a rifle bolt firing mechanism, such that when said compressed air is directed to flow within said rifle barrel, said piston and cylinder sliding motion simulates a rifle bolt firing action, and rapid release of said compressed air via said piston and cylinder gap simulates recoil.

In the preferred embodiment, the rifle barrel itself serves as the cylinder and the piston is arranged for sliding motion therein, to provide the recoil effect. An end of the piston rod is provided with O-rings to seal it against the inside walls of the cylinder (barrel). A portion of the barrel inside walls is conically-shaped, defining a gap which the O-rings do not seal. Travel of the piston rod end through this barrel portion enables rapid compressed air exhaustion via the gap, simulating recoil.

In an alternative embodiment, the piston rod remains stationary, and the cylinder (rifle bolt) slides on it, becoming actuated.

In still a further alternative embodiment, a separate gas barrel is provided, which communicates with the rifle barrel. The gas barrel is shaped conically and the piston slides therein.

The present invention provides many advantages over the design of prior art weapons simulators, among these being the use of the rifle barrel as the cylinder, without an external, installed cylinder. This significantly reduces maintenance costs, since only the O-rings must be replaced, which is possible without dismantling the entire rifle. Also, the user himself can perform this task in the field, in a quick and simplified fashion.

Other features and advantages of the invention will become apparent from the following drawings and description.

BRIEF DESCRIPTION OF THE DRAWINGS

For a better understanding of the invention with regard to the embodiments thereof, reference is made to the accompanying drawings, in which like numerals designate corresponding elements or sections throughout, and in which.

DETAILED DESCRIPTION OF THE PREFERRED EMBODIMENTS

Figure 1:
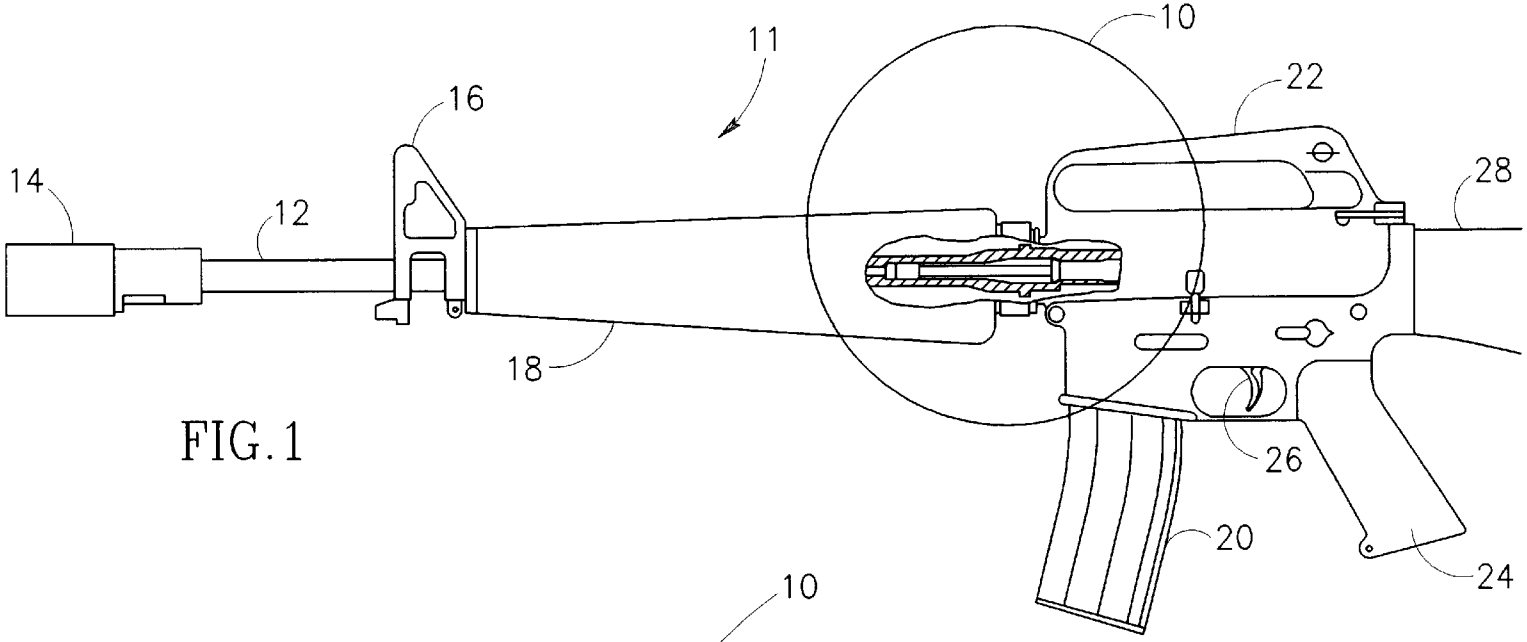
FIG. 1 is an overall side view of a recoil simulator constructed in accordance with the present invention.

Referring now to FIG. 1, there is shown an overall side view of a recoil simulator 10, constructed and operated in accordance with the principles of the present invention. Recoil simulator 10 may be built into a conventional automatic weapon 11, such as an automatic rifle of the M-16 design, featuring a barrel 12, a light beam/laser generator housing 14, front sight housing 16, handguard 18, magazine 20, carrying handle 22, pistol grip 24, trigger 26, and rifle butt 28.

Figure 2:
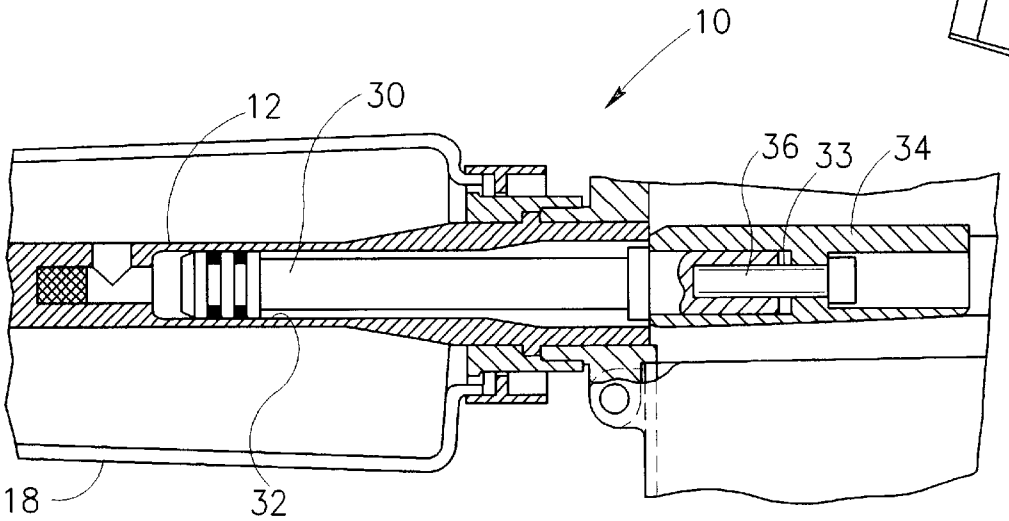
FIG. 2 shows an enlarged partial cross-section of FIG. 1, featuring a piston arranged to slide within a rifle barrel.

An enlarged partial cross-section of recoil simulator 10 is shown in FIG. 2. The major operating components comprise a piston rod 30 slidably seated in bore 32 of barrel 12, end 33 of which is attached to a rifle bolt 34 by a screw 36. Further construction details of these components are shown in FIGS. 3*a–b*.

Figure 3A:
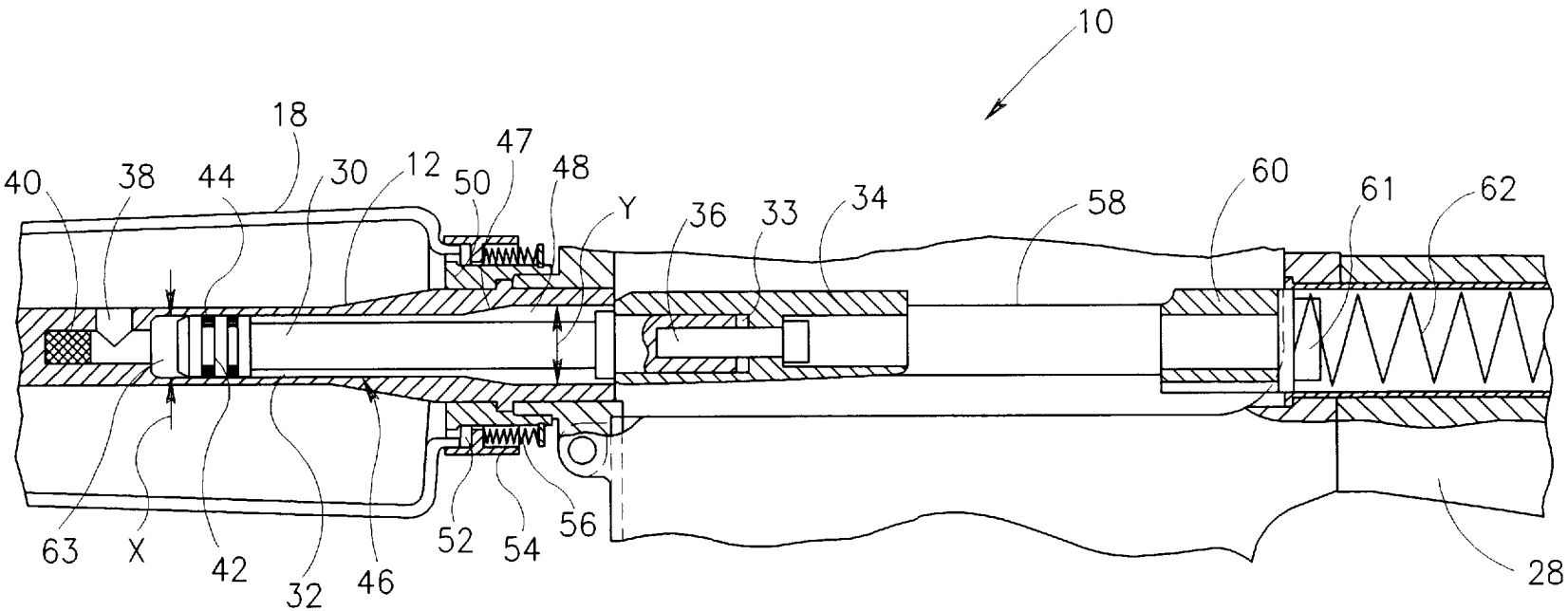
FIGS. 3*a–b* show a cross-section of the piston in the rifle barrel, respectively, before and after rifle bolt operation.
Figure 3B:
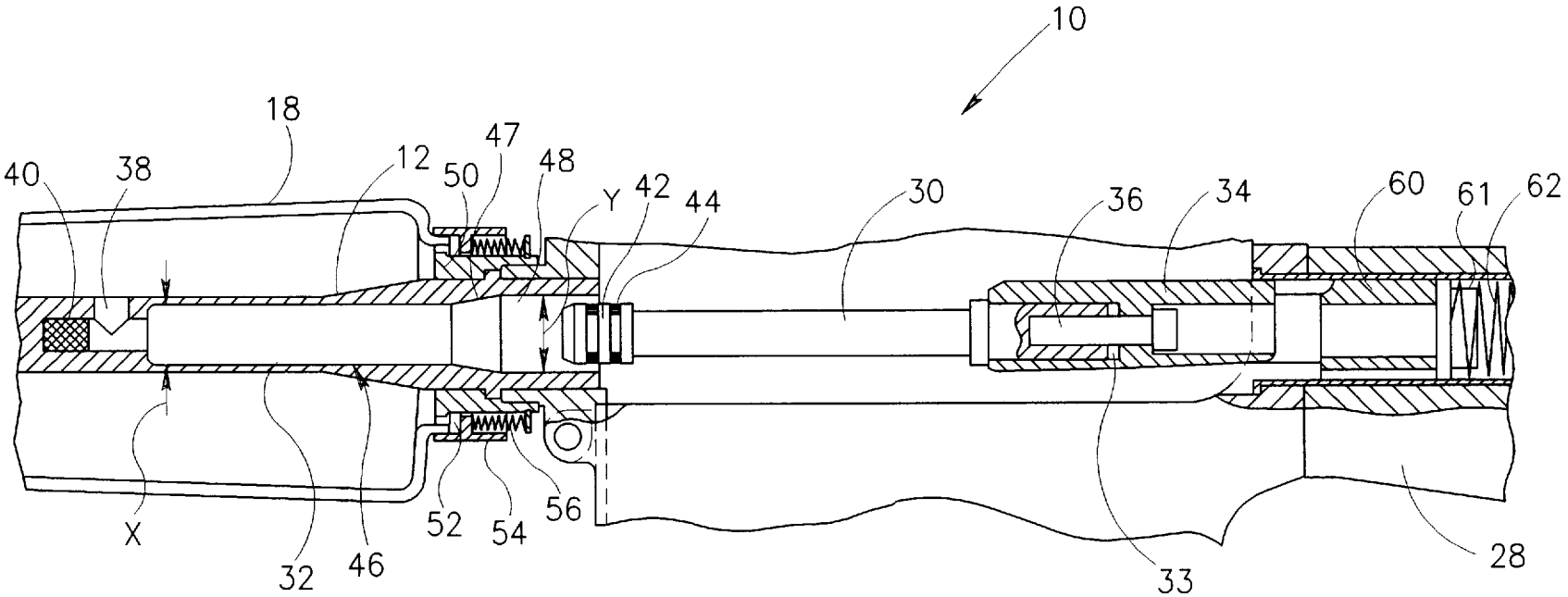

As shown in FIGS. 3*a–b*, barrel 12 is formed with a threaded air inlet opening 38, which is sealed proximate its exit end by a plug 40. The face end of piston rod 30 is formed with annular grooves 42 in which there are seated O-rings 44 for sealing against the bore 32 of barrel 12.

In accordance with the principles of the present invention, the bore 32 of barrel 12 is modified by widening it to a dimension "X", defining a cylinder 46 in which piston rod 30 is slidably seated. Bore 32 widens further at conically-shaped portion 47 of barrel 12, and reaches dimension "Y", whereat O-rings 44 do not provide a seal, and a gap 48 (FIG. 3*b*) is defined.

In general construction, a threaded ring 50 engages the exterior of barrel 12 at an end portion 52 of handguard 18. The end portion 52 is positioned over ring 50, and a sliding ring 54 encompasses end portion 52 and ring 50, attaching handguard 18 to barrel 12. A spring 56 is provided to maintain sliding ring 54 in position, and when pushed against the spring 56 tension, end portion 52 is released to enable dismantling of handguard 18.

The end 33 of piston rod 30 is attached by screw 36 to rifle bolt 34, which slides on bolt carrier 58 (FIG. 3*a*). The end of bolt carrier 58 provides a spring driver 60 having a rubber cushion 61 which abuts against a return spring 62 disposed in rifle butt 28.

As shown in FIG. 3*a*, in operation, when compressed air is directed to flow via air inlet opening 38, air pressure builds up in space 63 against the face of piston rod 30, forcing it to slide in bore 32, comprising cylinder 46. During sliding motion of piston rod 30, the air pressure buildup is exhausted via the gap 48 (FIG. 3*b*) developed between O-rings 44 and bore 32, when piston rod 30 end reaches the conically-shaped portion 47 of barrel 12. The piston rod 30 motion and rapid release of air pressure develops realistic recoil action, similar to actual weapon firing. Piston rod 30 can exit past dimension "Y" of barrel 12, to leave it completely or to remain therein. In both situations, spring 62 recycles the firing mechanism, in normal operation, and restores piston rod 30 to its original position in cylinder 46. Conically-shaped portion 47 guides piston rod 30 re-entry in barrel 12.

The firing action of recoil simulator 10 can be controlled by the trigger mechanism which actuates the firing hammer. The firing hammer operation can be detected so that when the trigger is depressed, a sensor detects the movement of the firing hammer (not shown). This sensor can be an optical one, or a proximity switch arranged to control an air valve, allowing compressed air entry via inlet opening 38 when actuated.

Unlike prior art weapons simulators, the present invention features a construction which does not rely on the use of a self-contained air piston which is installed in a weapon. By use of the gun barrel 12 as the gas barrel, the buildup and release of air pressure simulates recoil action in a simplified, easy-to-maintain, and inexpensive recoil simulator 10. The modifications to the gun barrel 12 and the bolt 34 are built on the same center as established by the manufacturer of the rifle. In contrast, an installed air piston must be properly centered and fastened in position, so as not to affect the smoothness of the recoil action. This requirement is often difficult to achieve.

The maintenance cost is considerably reduced by the inventive design, by virtue of a piston which can easily and quickly be removed to replace the O-rings, within a minute. Thus, the entire recoil simulator 10 need not be dismantled, and the maintenance activity can be performed in the field, on location, without any tools, and not in the shop, by a technician.

The present invention exhibits a speed of firing action considerably higher than that common in prior art simulators, firing approximately 8–9 rounds per sec. vs. 2–3 rounds per sec.

In addition, the recoil force developed is several times stronger than that developed by an air-piston type design. The noise associated with gun loading is authentic. In contrast, the air-piston type design loses a portion of the recoil force and the noise, due to the friction and cushioning caused by forced air venting via a standard, small size port in the piston.

The invention directs compressed air flow in a single direction, for about 50 millisec, and the return spring provides a restoring force, so a total savings of above 50% is obtained in air pressure needed to maintain operation of the recoil simulator 10. This is since prior art simulators use a double-acting piston.

In prior art weapons simulators, the air piston is used to push and pull the bolt mechanism, and since the air piston motion is slower than the gun mechanism itself, the recoil feeling is not realistic. In contrast, the improvement in the present invention of using the gun barrel as the gas barrel adds significantly to the feeling of a true recoil action, since release of the air pressure buildup is performed in rapid fashion.

It will be appreciated by those skilled in the art that the exact design of recoil simulator 10 will depend on a number of factors associated with the weapon itself, such as the recoil distance, size of bullets used, spring force and piston size. From these factors, the appropriate mechanism operation can be determined, i.e., the distance (mm) needed, power needed to overcome the spring force, size of the bullet, and movement needed at maximum power until the hammer is cocked, before firing.

Since the gun barrel 12 is used as the cylinder, and it is longer than the recoil movement, it is possible to obtain any desired recoil length under maximum power. This is not possible with an installed piston, especially where the weapon has a short butt, or a folding butt, since these have insufficient length. In these cases, generally, the prior art solution has been to cut the gun barrel and insert a pneumatic piston in a cut portion thereof, but this involves major modifications, including provision of a housing around the piston, to strengthen it. Maintenance of this type of construction is very costly and slow.

Figure 4A:
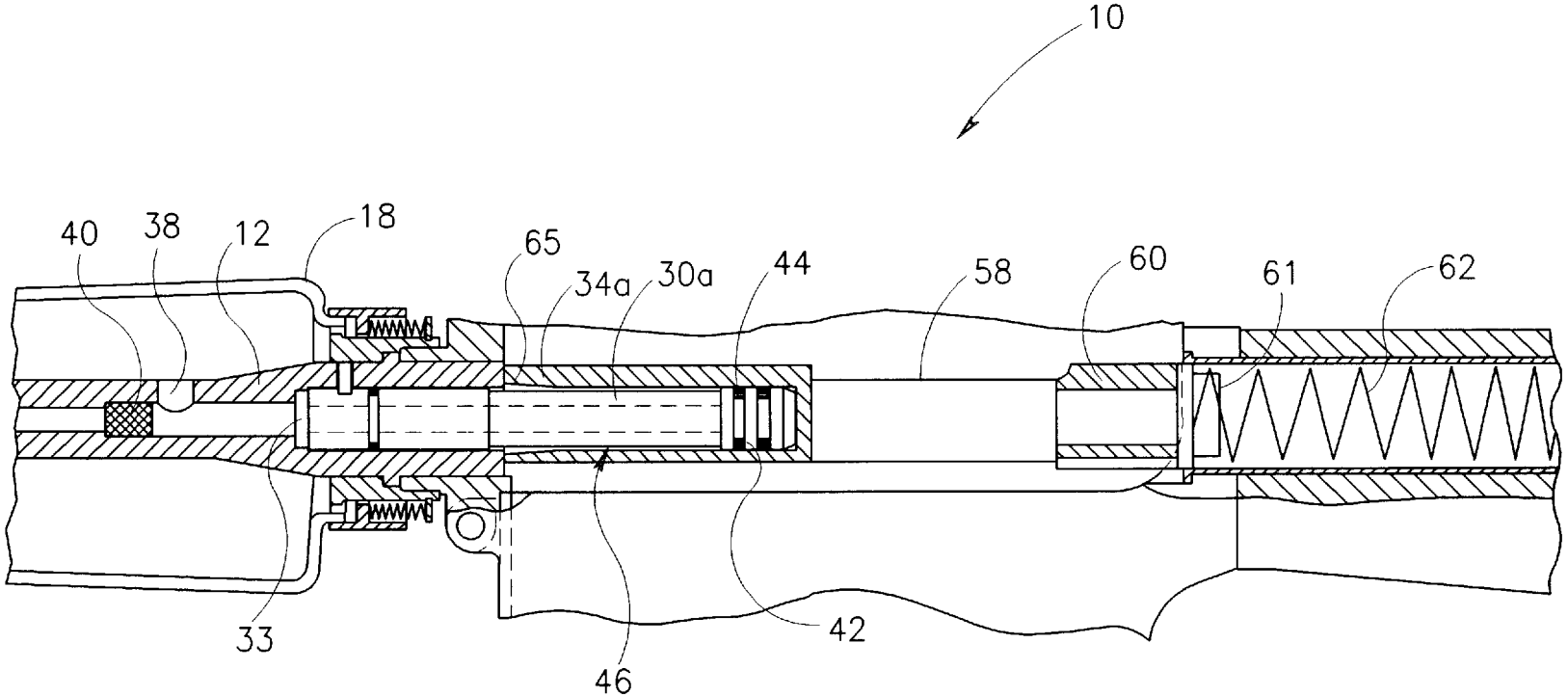
FIGS. 4*a–b* show an alternative embodiment of the recoil simulator, in which the piston is stationary and the cylinder moves.
Figure 4B:
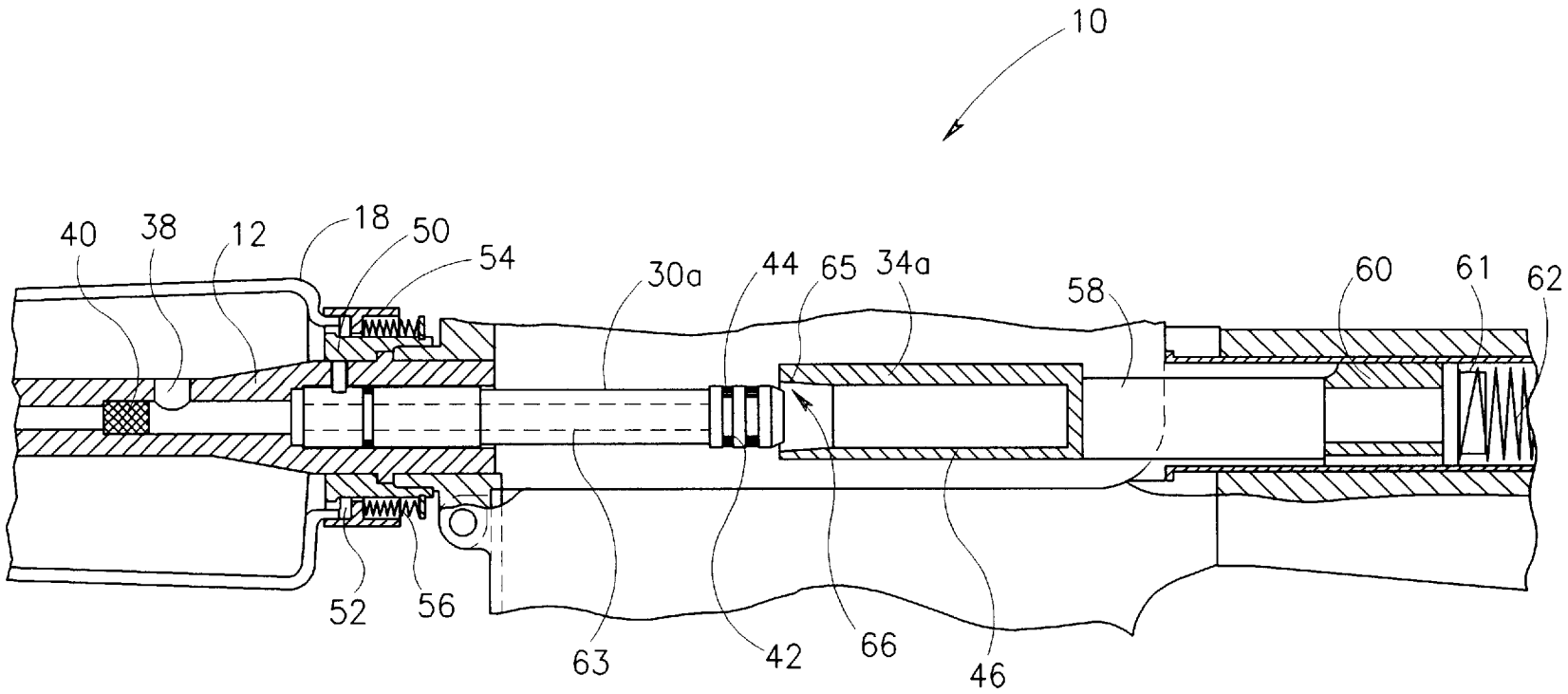

Referring now to FIGS. 4*a–b*, an alternative embodiment of the inventive recoil simulator 10 can be constructed,in which piston rod 30*a* is stationary and the modified bolt 34*a*, comprising the cylinder 46 (FIG. 4*b*), moves. This construction is the reverse of the embodiment of FIGS. 3*a–b*. As shown, end 33 of piston rod 30*a* is seated in barrel 12, and cylinder 46 is arranged to slide over it. The piston rod 30*a* is formed with a central borehole 63 allowing air to pass therethrough. The modified bolt 34*a* has a conically-shaped end 65.

When air pressure is developed in barrel 12 via air inlet opening 38, and fed via borehole 63 of piston rod 30*a*, modified bolt 34*a* is forced to slide away from it. The conically-shaped end 65 of bolt 34*a* and O-rings 44 define a gap 66 therebetween, which exhausts the compressed air. As before, the rapid release of air pressure simulates recoil action, and spring 62 recycles the firing mechanism, in normal operation.

Figure 5A:
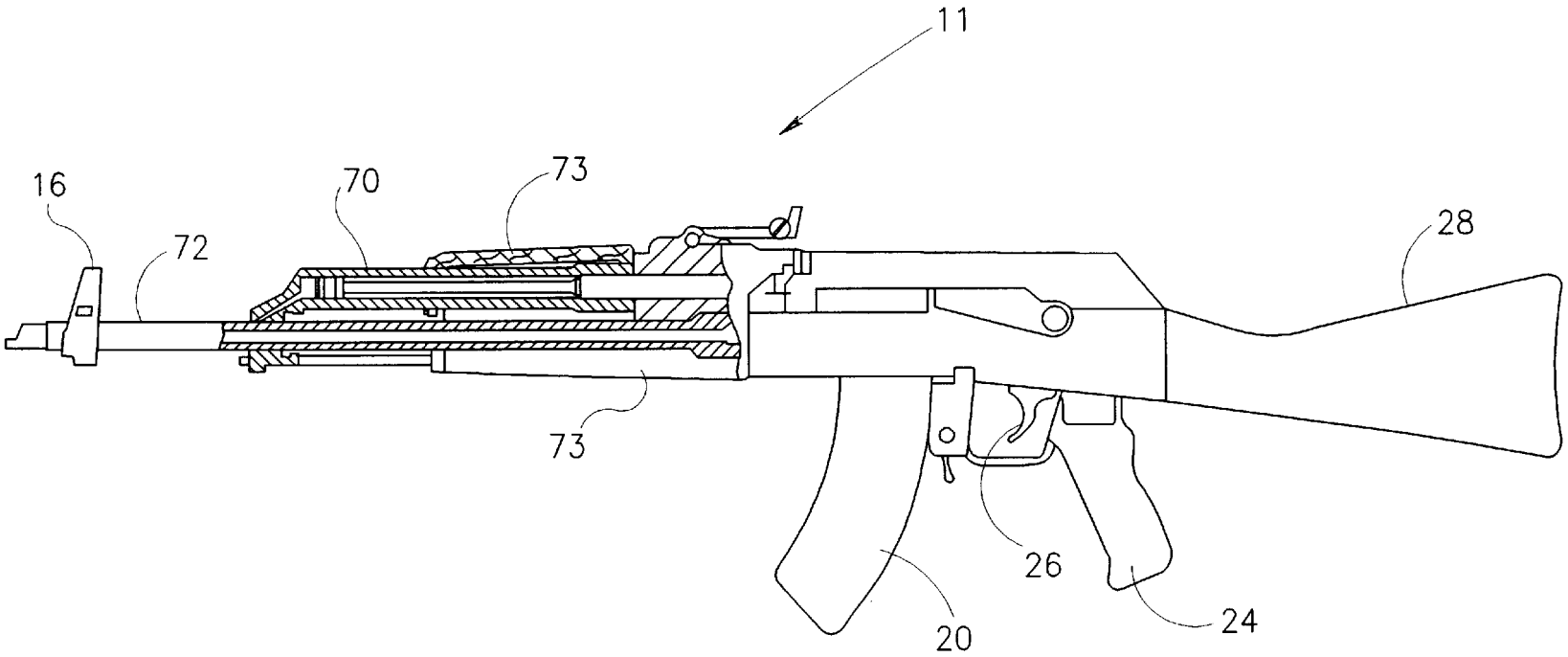
FIGS. 5*a–c* show another alternative embodiment of the recoil simulator having a separate gas barrel for piston motion.
Figure 5B:
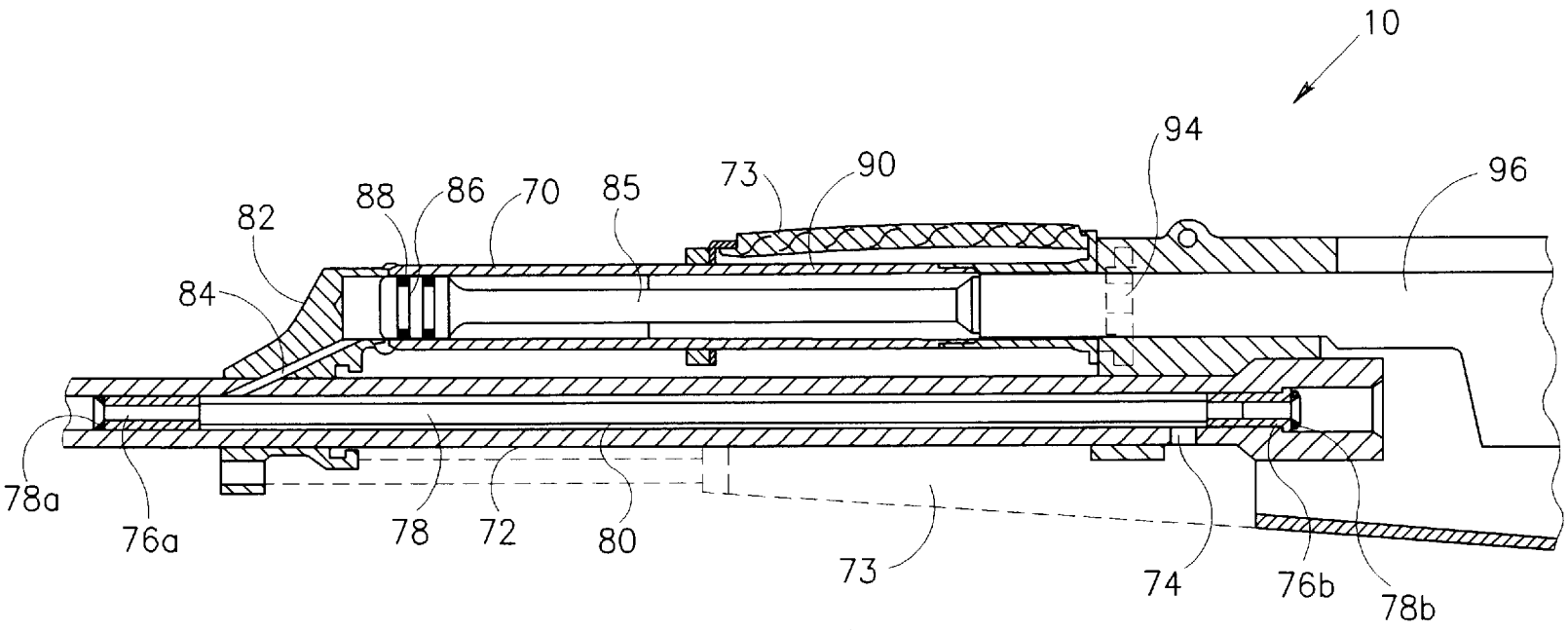
Figure 5C:
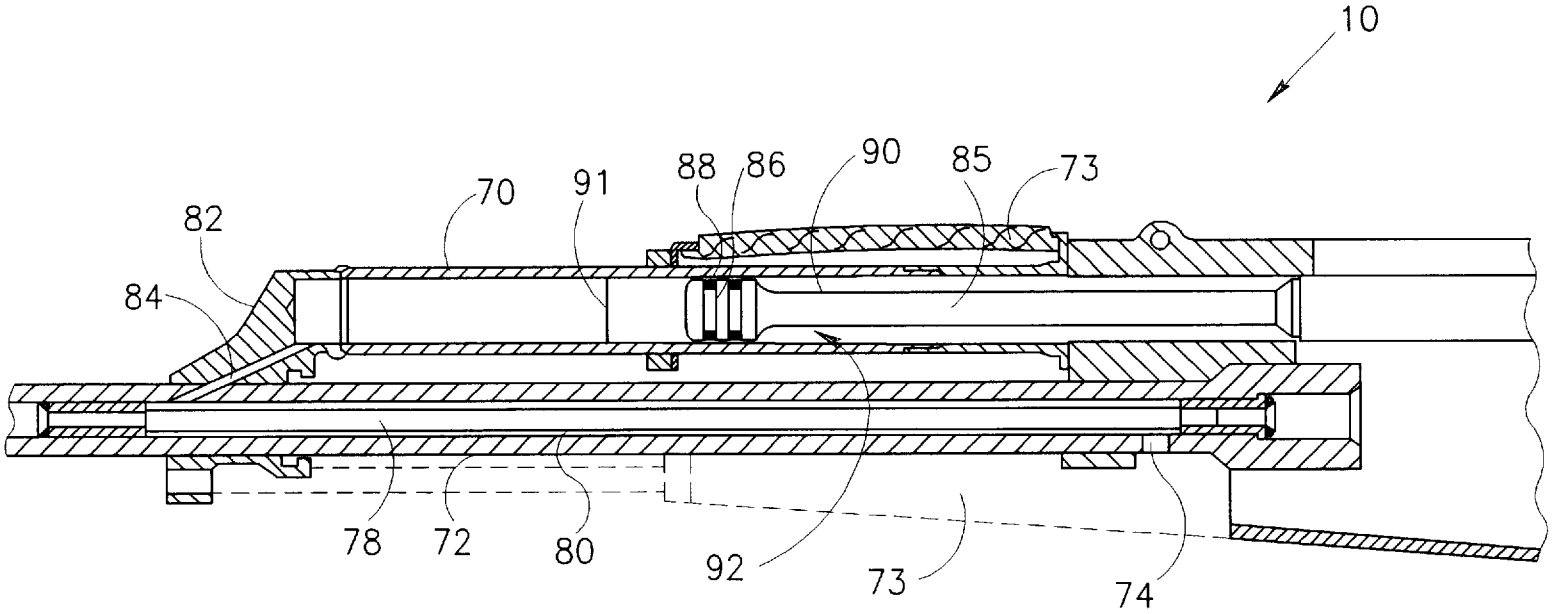

Referring now to FIGS. 5*a–b*, another alternative embodiment of the present invention is shown, featuring a separate gas barrel cylinder 70 in addition to the gun barrel 72. This design can be adapted to a conventional automatic weapon, such as an automatic rifle of the AK-47 type, having a wood handguard 73. A threaded air inlet opening 74 is formed in an end of barrel 72, and a set of plugs 76*a–b* and O-rings 78*a–b* seal the opposite ends of the barrel 72. A reducing rod 78 disposed within barrel 72 defines a narrow air flow space 80 with the barrel walls. The interior of the gas barrel cylinder support 82 is formed with a gas channel 84 establishing fluid communication with the separate gas barrel cylinder 70. Gas barrel cylinder 70 replaces the original gas cylinder, which does not develop sufficient pressure, using compressed air. This is because it is designed to recoil when a bullet is fired, which releases ten times more pressure than a standard air compressor can provide.

Gas barrel cylinder 70 has seated therein a piston 85, formed with annular grooves 86 in its face end for seating a set of O-rings 88. The bore of gas barrel cylinder 70 is formed with a tapered, conically-shaped barrel portion 90, beginning at location 91, such that a gap 92 is defined between it and the O-rings 88 of piston 85. The other end of piston 85 is attached by pins 94 to the rifle bolt 96.

In operation, when a trigger mechanism (not shown) is actuated, compressed air is directed to flow via air inlet opening 74 into gun barrel 72, and through the air flow space 80. The compressed air continues to build up, and is blocked by plug 76*a*, and then flows via gas channel 84 and eventually is sufficient to force piston 85 to move rearwardly, actuating the rifle bolt 96 mechanism. With continued rearward motion of piston 85, O-rings 88 reach conically-shaped barrel portion 90 and the compressed air exhausts via gap 92, simulating recoil action.

In summary, the present invention provides many advantages over the design of prior art weapons simulators, among these being the use of the rifle barrel as the cylinder, without an external, installed cylinder. This significantly reduces maintenance costs, since only the O-rings need to be replaced, which can be done without dismantling the entire rifle. Also, the user himself can perform this task in the field, instead of a requiring a shop repair of an installed piston.

In addition, the inventive recoil simulator, by using the rifle barrel as the gas barrel, adds significantly to the feeling of a true recoil action, since release of the air pressure buildup is performed in rapid fashion via the gap.

Having described the invention with regard to certain specific embodiments thereof, it is to be understood that the description is not meant as a limitation, since further modifications may now suggest themselves to those skilled in the art, and it is intended to cover such modifications as fall within the scope of the appended claims.

I claim:

1. A recoil simulator for a weapon comprising:

a rifle barrel having a sealing plug disposed therein proximate an exit end thereof, said barrel being formed with an inlet opening behind said plug for entry of compressed air therein; and a piston rod and cylinder arranged for sliding motion one with respect to the other, a gap being developed therebetween during a portion of said sliding motion, said cylinder being in fluid communication with said barrel inlet opening, said sliding motion being arranged to actuate a rifle bolt firing mechanism, such that when said compressed air is directed to flow within said rifle barrel, said piston and cylinder sliding motion simulates a rifle bolt firing action, and rapid release of said compressed air via said piston and cylinder gap simulates recoil.

2. The simulator of claim 1 wherein a portion of said rifle barrel is modified to increase its diameter, said modified barrel portion constituting said cylinder.

3. The simulator of claim 2 wherein said piston rod is arranged for sliding motion within said cylinder which is fixed.

4. The simulator of claim 1 wherein said rifle bolt firing mechanism is modified to provide said cylinder.

5. The simulator of claim 4 wherein said cylinder is arranged for sliding motion on said piston rod which is fixed.

6. The simulator of claim 1 further comprising a gas barrel cylinder in fluid communication with said rifle barrel.

7. The simulator of claim 6 wherein said piston rod is arranged for sliding motion within said gas barrel cylinder which is fixed.

8. The simulator of claim 1 wherein said gap is defined as a space between a conically-shaped end portion formed on said cylinder, and a face end of said piston rod.

9. The simulator of claim 8 wherein said conically-shaped end portion of said cylinder guides said piston when it is retracted therein during a return portion of its sliding motion.

10. The simulator of claim 1 wherein said simulated firing action is performed at a speed of approximately 8–9 rounds per second.

11. The simulator of claim 1 wherein said simulated firing action develops a recoil force several times stronger than a recoil force associated with an air-piston type simulator.

12. The simulator of claim 1 wherein said simulated firing action develops an authentic gun loading noise.

13. A method of operating a recoil simulator for a weapon comprising the steps of:

providing a rifle barrel having a sealing plug disposed therein proximate an exit end thereof, said barrel being formed with an inlet opening behind said plug for entry of compressed air therein;

providing a piston rod and cylinder arranged for sliding motion one with respect to the other, a gap being developed therebetween during a portion of said sliding motion, said cylinder being in fluid communication with said barrel inlet opening, said sliding motion being arranged to actuate a rifle bolt firing mechanism; and directing compressed air to flow within said rifle barrel, such that said piston and cylinder sliding motion simulates a rifle bolt firing action, and rapid release of said compressed air via said piston and cylinder gap simulates recoil.

14. The method of claim 13 wherein a portion of said rifle barrel is modified to increase its diameter, said modified barrel portion constituting said cylinder.

15. The method of claim 14 wherein said piston rod is arranged for sliding motion within said cylinder which is fixed.

16. The method of claim 13 wherein said rifle bolt firing mechanism is modified to provide said cylinder.

17. The method of claim 16 wherein said cylinder is arranged for sliding motion on said piston rod which is fixed.

18. The method of claim 13 further comprising a gas barrel cylinder in fluid communication with said rifle barrel.

19. The method of claim 18 wherein said piston rod is arranged for sliding motion within said gas barrel cylinder which is fixed.

20. The method of claim 13 wherein said gap is defined as a space between a conically-shaped end portion formed on said cylinder, and a face end of said piston rod.

21. The method of claim 20 wherein conically-shaped end portion of said cylinder guides said piston when it is retracted therein during a return portion of its sliding motion.

22. The method of claim 13 wherein said firing action in performed at a speed of approximately 8–9 rounds per second.

23. The method of claim 13 wherein said simulated firing action develops a recoil force several times stronger than a recoil force associated with an air-piston type simulator.

24. The method of claim 13 wherein said simulated firing action develops an authentic gun loading noise.

* * * * *